US009028016B2

(12) United States Patent
Glenn, Jr.

(10) Patent No.: US 9,028,016 B2
(45) Date of Patent: May 12, 2015

(54) PORTABLE FOLDING CLOSET

(71) Applicant: Household Essentials, LLC., Hazelwood, MO (US)

(72) Inventor: James L. Glenn, Jr., St. Albans, MO (US)

(73) Assignee: Household Essentials, LLC, Hazelwood, MO (US)

( * ) Notice: Subject to any disclaimer, the term of this patent is extended or adjusted under 35 U.S.C. 154(b) by 0 days.

(21) Appl. No.: 14/196,823

(22) Filed: Mar. 4, 2014

(65) Prior Publication Data

US 2014/0246967 A1 Sep. 4, 2014

Related U.S. Application Data

(60) Provisional application No. 61/772,438, filed on Mar. 4, 2013.

(51) Int. Cl.
*A47B 43/00* (2006.01)
*A47B 43/04* (2006.01)

(52) U.S. Cl.
CPC ..... *A47B 43/00* (2013.01); *A47B 43/04* (2013.01)

(58) Field of Classification Search
CPC ..... A47B 43/00; A47B 43/04; A47B 43/02
USPC ..... 312/107, 108, 111, 213, 257.1, 258, 312/264; 150/154; 135/121, 143, 144
See application file for complete search history.

(56) References Cited

U.S. PATENT DOCUMENTS

| | | | | |
|---|---|---|---|---|
| 1,615,265 | A * | 1/1927 | Fleischman | 312/6 |
| 3,139,205 | A * | 6/1964 | Haubrich | 217/47 |
| 3,874,398 | A * | 4/1975 | Hendrickson | 135/144 |
| 6,601,723 | B1 * | 8/2003 | Ziglar | 220/4.34 |
| 6,840,254 | B1 * | 1/2005 | Windham | 135/91 |
| 7,231,673 | B1 * | 6/2007 | Arnold et al. | 4/599 |
| 7,748,798 | B2 * | 7/2010 | LeTourneau et al. | 312/258 |
| 2009/0001033 | A1 * | 1/2009 | Sung | 211/85.3 |
| 2010/0043856 | A1 * | 2/2010 | Park et al. | 135/145 |
| 2010/0269877 | A1 * | 10/2010 | Sy-Facunda | 135/145 |
| 2011/0290291 | A1 * | 12/2011 | Neal | 135/96 |
| 2012/0211042 | A1 * | 8/2012 | Richter | 135/143 |
| 2012/0325279 | A1 * | 12/2012 | Munoz | 135/93 |

* cited by examiner

*Primary Examiner* — Daniel Rohrhoff
(74) *Attorney, Agent, or Firm* — Polster, Lieder, Woodruff & Lucchesi, L.C.

(57) ABSTRACT

A collapsible closet assembly has a pair of generally vertical rigid walls, and a plurality of generally flexible panels extending between the pair of rigid walls. A plurality of supports pivotally connect between the pair of vertical rigid walls and attach to the plurality of generally flexible panels, for movement of the plurality of supports, the pair of vertical walls, and the plurality of generally flexible panels between a collapsed position for storage and an expanded position for operation.

18 Claims, 5 Drawing Sheets

PORTABLE FOLDING CLOSET

CROSS-REFERENCE TO RELATED APPLICATIONS

This Non-Provisional application claims priority to U.S. Provisional Application Ser. No. 61/772,438 filed Mar. 4, 2013, and which is incorporated herein by reference.

BACKGROUND

This invention relates to a closet assembly, and more specifically to an easily stored, collapsible closet.

In today's global economy, consumers are developing new preferences about how they buy products. For instance, more and more consumers are purchasing products from internet websites rather than brick and mortar stores. Items purchased from an internet website are typically shipped directly to the consumer. In contrast, brick and mortar stores typically by items in bulk for consumers to come buy at the store. The increased amount of internet purchases requires a different strategy for shipping the products. Packaging and shipping items individually for internet purchases is quite different from packaging and shipping bulk quantities of products.

In order to reduce packaging and shipping costs, it is advantageous to reduces the size of a particular product. Conventional closet assembly products are large bulky items that are expensive to package and ship. Therefore, what is needed is a collapsible closet assembly.

DETAILED DESCRIPTION

Figure 1:
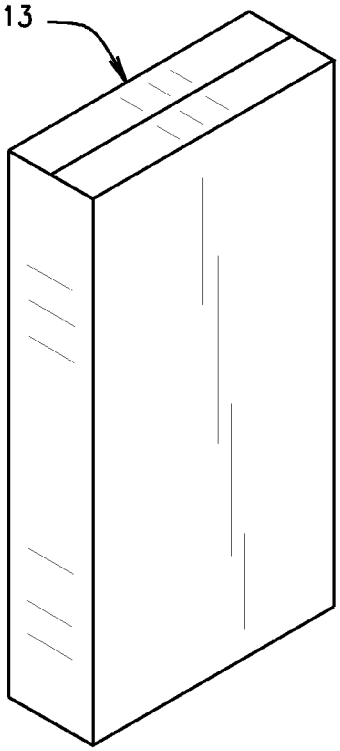
FIG. 1 is an isometric view of a shipping container enclosing a collapsible, portable, foldable closet assembly according to an embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIGS. 1-7, there is shown a collapsible, portable, foldable closet assembly 11. FIG. 1 shows the collapsible, portable, foldable closet assembly 11 packed for shipment in shipping container 13. As seen in FIGS. 2-7, the portable, foldable closet assembly 11 generally has a left rigid wall 12 and a right rigid wall 14, a plurality of foldable supports 16 each including a locking arm 18, and a folding "X" shaped cross-brace 20. The portable, foldable closet assembly 11 further includes a top panel 24, bottom panel 26, rear panel 28, and front panel 30, preferably constructed from a flexible fabric, such as canvas. The term "fabric" refers to a cloth produced especially by knitting, weaving, or felting fibers of any type. The term flexible or flexible panel refers to a material or wall that is flaccid, such as cloth or fabric walls. The left rigid wall 12 and right rigid wall 14 are preferably constructed of wood. Cedar wood is particularly advantageous due to its fungus and insect repellant properties, fragrance, durability, and moisture repellant properties.

Figure 11:
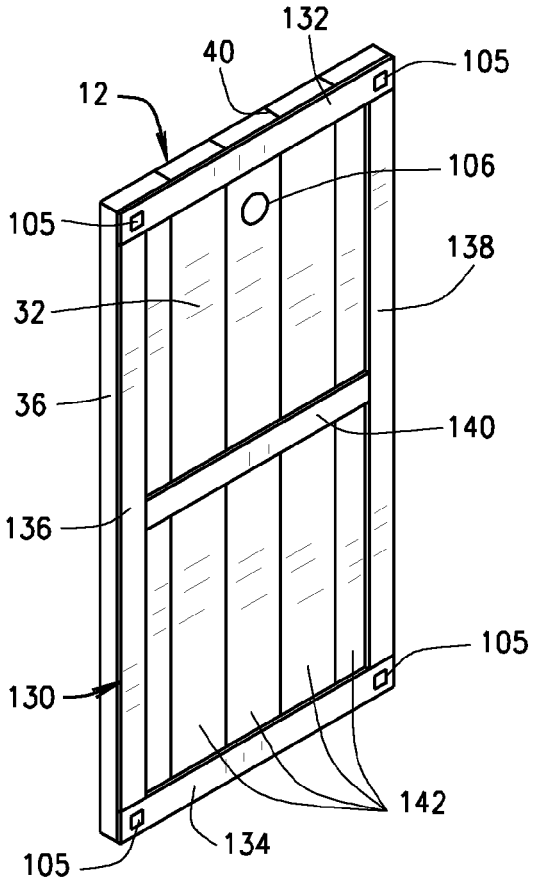
FIG. 11 is an isometric view of an inner surface of a rigid wall of the collapsible, portable, foldable closet assembly, according to an embodiment of the present invention.
Figure 12:
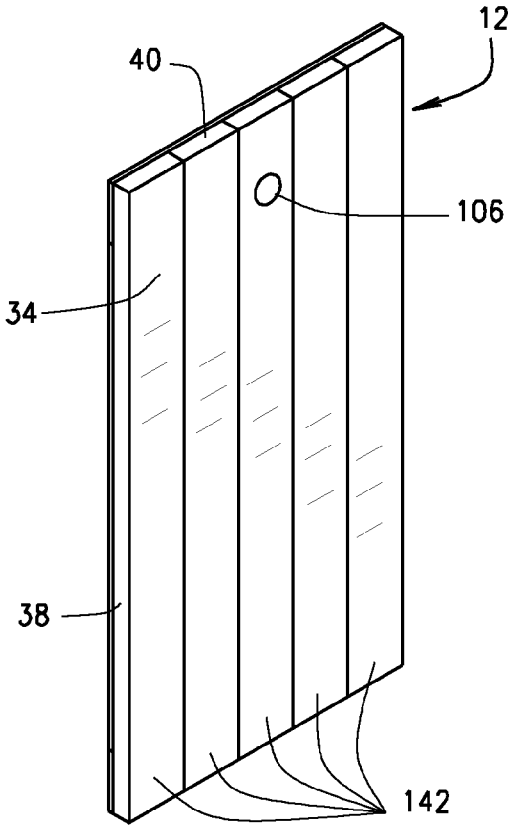
FIG. 12 is an isometric view of an outer surface of a rigid wall of the collapsible, portable, foldable closet assembly, according to an embodiment of the present invention.

As shown in FIGS. 11 and 12, the left rigid wall 12 has a left backing frame 130 which has a generally horizontal top member 132 and a bottom member 134, generally vertical side members 136 and 138, a generally horizontal cross member 140 and generally vertical planks 142. The left rigid wall 14 is constructed by fastening a top edge 144 of planks 142 to the top member 132 of the left backing frame 130, preferably with stapes. One skilled in the art will recognize that other suitable fastening methods may be used, including but not limited to, nails, screws or adhesive. The bottom member 134, the side members 136 and 138, the cross member 140 are attached to the planks 142 in a similar fashion as just described with regard to the top member 132. In an exemplary embodiment, the top member 132, the bottom member 134, the side members 136 and 138, the cross member 140 have a width of about 1.25 inches (3.2 cm) and a thickness about of 0.5 inches (1.3 cm). The planks 142 have a thickness of approximately 0.25 inch (0.64 cm). The top member 132, the bottom member 134 and the planks 142 have a length of approximately 42 inches (106.7 cm). The side members 136 and 138 have a length of approximately 19.5 inches (49.5 cm). The cross member 140 has a length of about 17 inches (42.2 cm).

The left rigid wall 12 generally has the shape of a rectangular prism, although other shapes, for example, square, triangular or trapezoidal could be used. In an exemplary embodiment, the left rigid wall 12 has a height of approximately 42 inches (106.7 cm), a width of approximately 19.5 inches (49.5 cm), and a thickness of 0.75 inches (1.9 cm) in areas where both the planks 142 and any of the frame members 132, 134, 136, 138 and 140 are present. The foregoing dimensions can vary depending on the storage space considerations.

The left rigid wall 12 has an inner surface 32, which is formed by the inner surfaces of planks 142 and the left backing frame 130, and an outer surface 34 which is formed by the outer surfaces of planks 142. The left backing frame 130 has a front edge 36, a rear edge 38, a top edge 40, and bottom edge 42.

The right rigid wall 14 is constructed in a similar manner to that just described for the left rigid wall 14. Accordingly the right rigid wall 14 has similar exemplary dimensions as just given for the left rigid wall 14. The right rigid wall 12 has an inner surface 44, which is formed by the planks 142 and the right backing frame (not shown), and an outer surface 46 which is formed by planks 142. The right backing frame has a front edge 52, a rear edge 54, a top edge 56, and a bottom edge 58.

Figures 8, 9, 10:
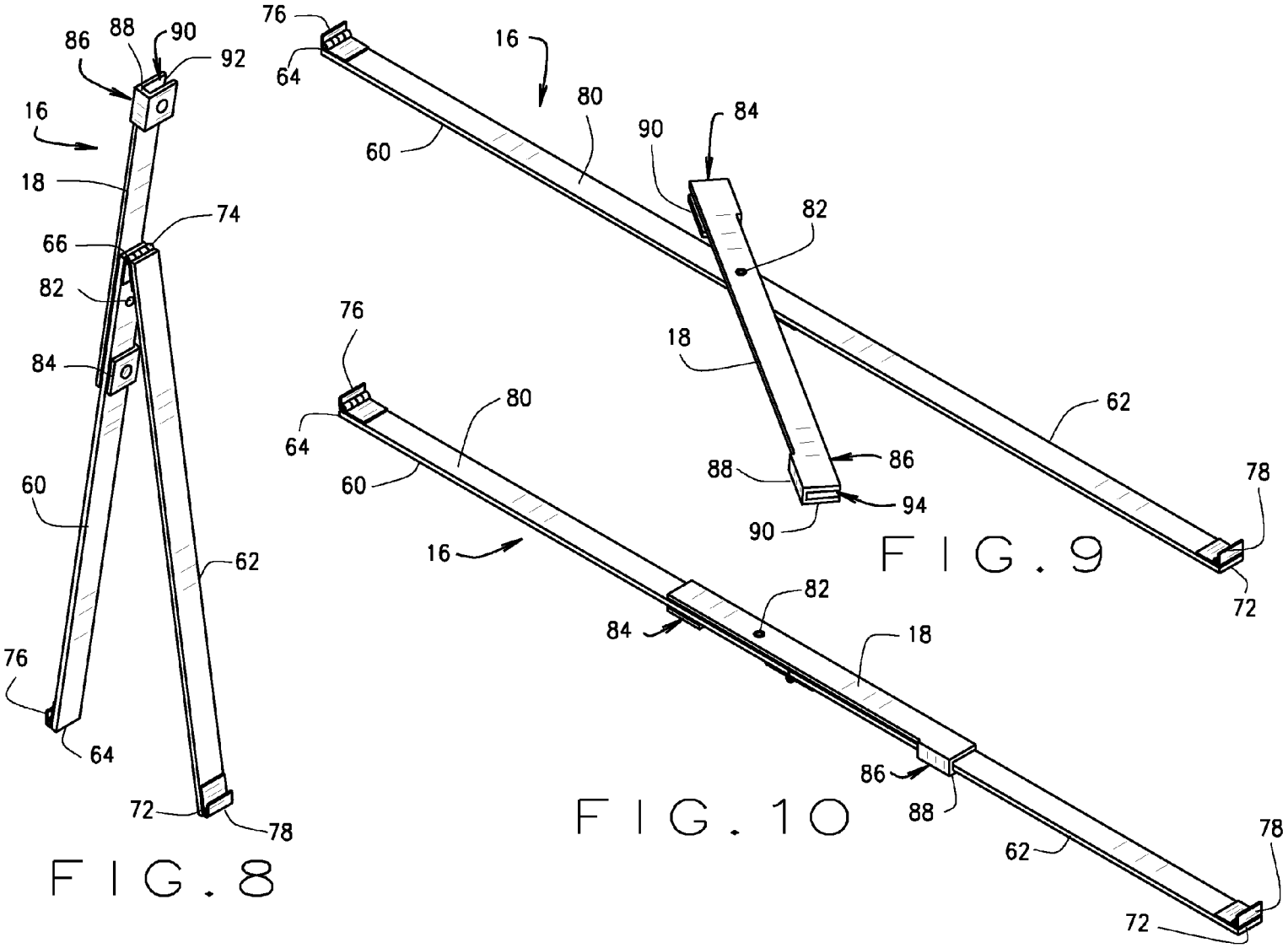
FIG. 8 is an isometric view of a foldable support in a partially collapsed position, according to an embodiment of the present invention.
FIG. 9 is an isometric view of a foldable support in an expanded, unlocked position, according to an embodiment of the present invention.
FIG. 10 is an isometric view of foldable support in an expanded, locked position, according to an embodiment of the present invention.

As shown in FIGS. 8-10, each foldable support 16 has a first arm 60 and a second arm 62. The first arm 60 has a distal end 64 and a proximal end 66. The second arm 68 has a first end 70 and a second end 72. The second end 64 of the first arm 60 is connected to first end 70 of the second arm 68 by center hinge 74. Hinges 76, 78 are respectively connected to the distal end 64 of the first arm 60 and the second end 72 of the second arm 68.

The locking arm 18 of each foldable support 16 is pivotally connected to an upper surface 80 of the first arm 60 by a fastener 82. Preferably, the fastener 82 is a rivet, but any fastener that connects the locking arm 18 to the first arm 60 and allows rotation of the locking arm 18 with respect to the first arm 60 would be suitable. The locking arm 18, preferably, includes a unitary "L" shaped tabs 84 and 86, at each end of the locking arm 18. Each tab 84 and 86 has a first leg 88 which bends approximately at a right angle into a distal foot-section 90. The tabs 84, 86 extend axially away from the centerline of the locking arm 18 in opposite directions with respect to the centerline. Tabs 84 and 86 are folded over to form "U" shaped channels 92, 94. The "U" shaped channels 92, 94 are formed such that the length of the first leg 88 of each tab 84, 86 of the locking arm 18 is larger than the thickness of each of the first arm 60 and second arm 62. The "L" shaped tabs 84 and 86 can be separate pieces from the other portions of the locking arm 18, and secured to the locking arm 18 such as by spot welding.

In an alternative embodiment, the components of foldable support 16 just described can be formed of materials other than metal, such as molded plastic.

The folding "X" shaped cross-brace 20 of the portable, foldable closet assembly 11 includes a first support strut 96 and a second support strut 98. Each support strut 96 and 98 have a pair of flattened ends 97 and 99. The first support strut 96 and the second support strut 98 are pivotally connected together at a flattened section near their centers by fastener 100. Preferably, the fastener 100 is a rivet, but any fastener that connects the first support strut 96 and the second support strut 98 and that allows the first support strut 96 and the second support strut 98 to pivot with respect to each other would be suitable. A connector 102 is attached to each end 99 of the first support strut 96 and the each end 99 of the second support strut 98. As shown in FIG. 6A, two connectors 103, each shaped to interlock with the connector 102 are attached to the rear edge 36 of the left rigid wall 12, two additional mating connectors are attached to the rear edge 52 of the right rigid wall 14. The mating connectors are attached to the outside of the rear panel 28.

Figure 6:
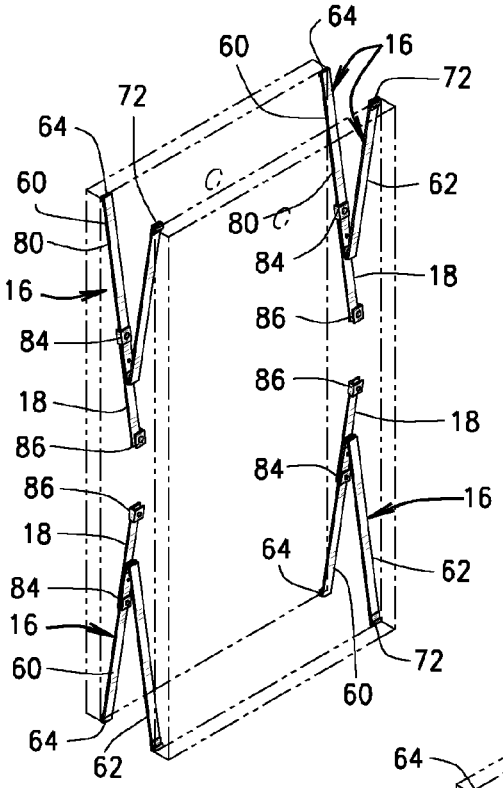
FIG. 6 is a cut-away isometric view of the collapsible, portable, foldable closet assembly in a partially collapsed position, according to an embodiment of the present invention.
Figure 6A:
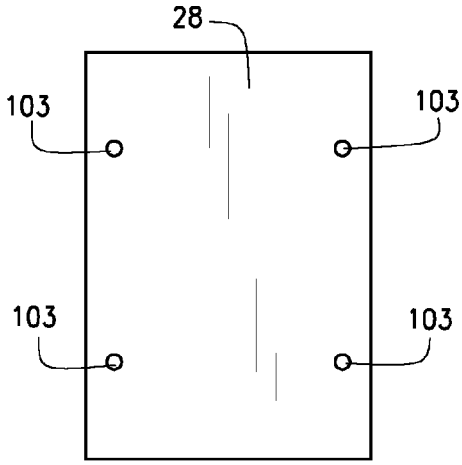
FIG. 6A is a rear view of the collapsible, portable, foldable closet assembly, showing the connectors for attaching a cross-brace, according to an embodiment of the present invention
Figure 7:
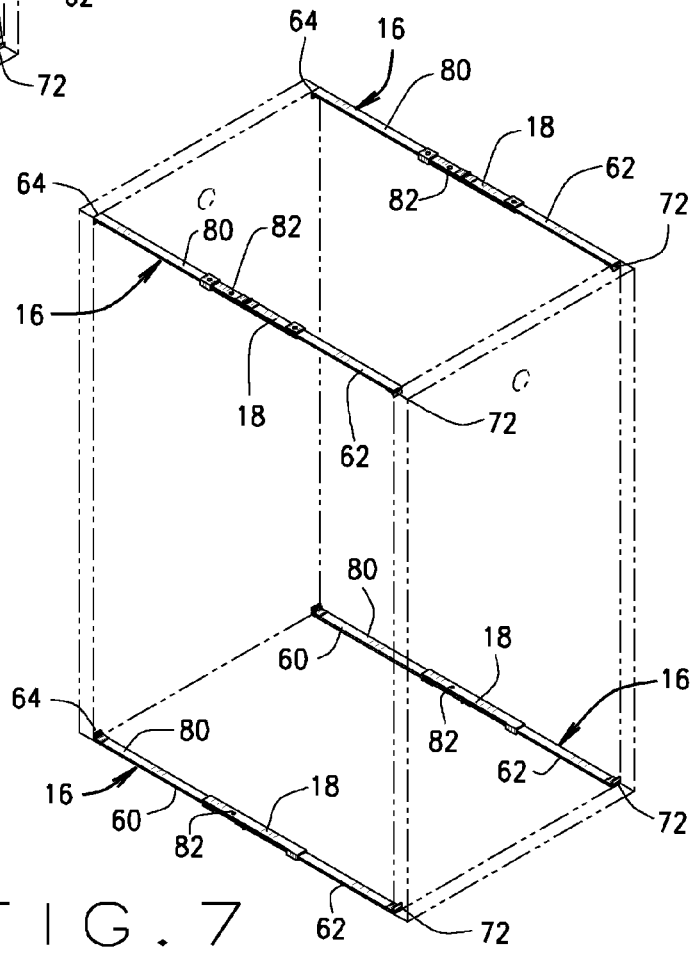
FIG. 7 is cutaway isometric view of the collapsible, portable, foldable closet assembly in an expanded position, according to an embodiment of the present invention.

In an embodiment, more specifically shown in FIGS. 6 and 7, four foldable supports 16 are provided. The hinge 76 at the distal end 64 of the first arm 60 of the respective foldable supports 16 is fixedly attached to near each corner of the inner surface 32 of left rigid wall 12. Similarly, the hinge 78 at the second end 72 of the second arm 68 of the respective foldable supports 16 is fixedly attached to near each corner of the inner surface 48 of right rigid wall 14. In an embodiment, a metal plate 105 is attached to each corner of inner surfaces 32, 48. Hinges 76, 78 are attached to metal plate 105 as via spot welds. Alternatively, one skilled in the art will recognize that a variety of other methods of attaching the hinges 76, 78 and metal plates 105 to inner surfaces 32, 48 can be used such as a screws, adhesives, etc. In an alternative embodiment, the hinges 76, 78 can be directly connected to inner surfaces 32, 48, omitting metal plates 104.

Figure 2:
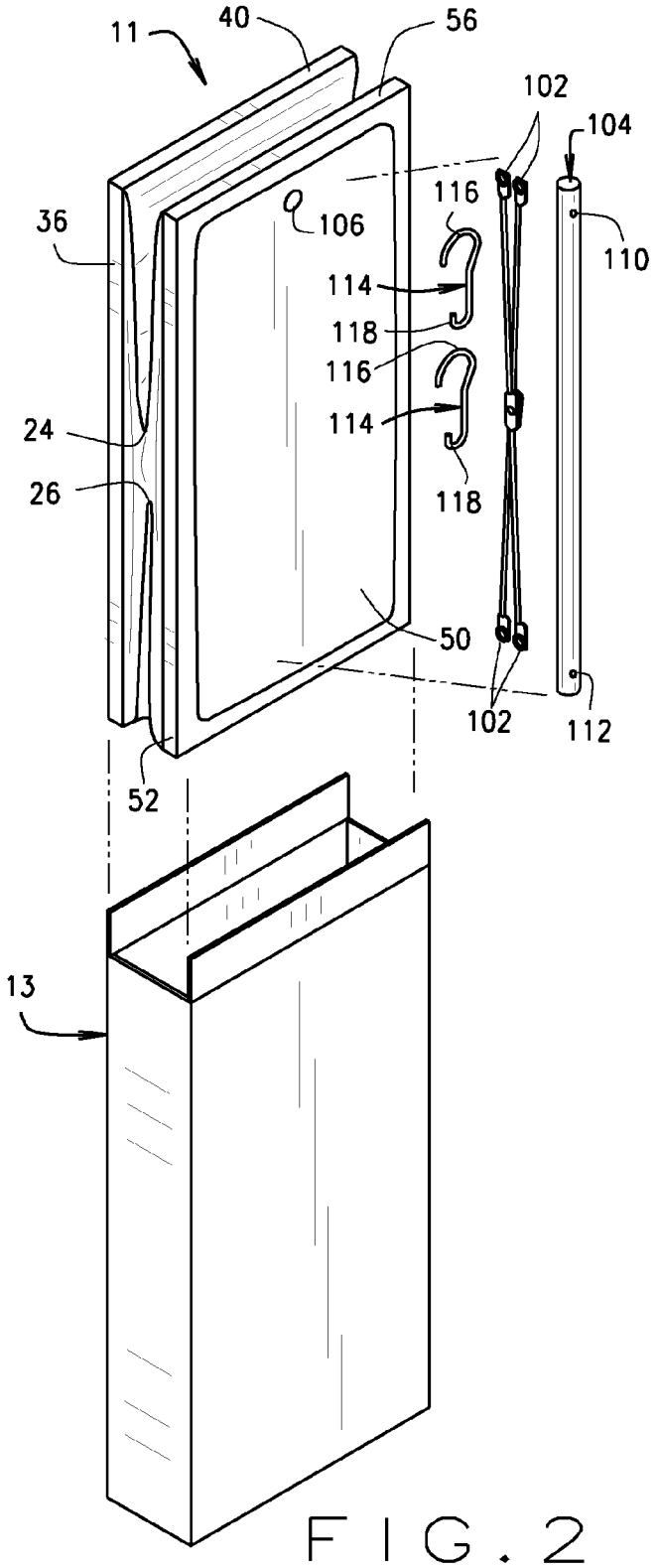
FIG. 2 is an isometric view of the collapsible, portable, foldable closet assembly in a collapsed position and ready to be inserted into the shipping container according to an embodiment of the present invention.
Figure 5:
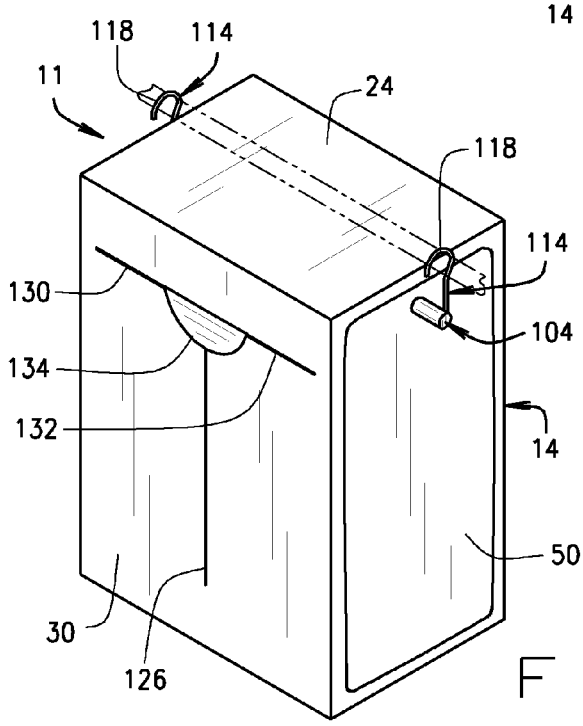
FIG. 5 is a right isometric view of the collapsible, portable, foldable closet assembly in an expanded position, showing the collapsible, portable, foldable closet assembly ready for hanging according to an embodiment of the present invention.

As shown in FIGS. 2 and 5 the portable, foldable closet assembly 11 further includes a hanging rod 104, which is preferably cylindrical in shape. To facilitate the mounting of the hanging rod 104, the left rigid wall 12 and right rigid wall 14 each contain a hole 106, located near their respective top edges 40, 56 and roughly centered between their respective front edges 36, 52 and rear edges 38, 54. The diameter of hole 106 is chosen so that hanging rod 104 can fit through hole 106, with some clearance to spare. The length of the hanging rod 104 is preferably longer than the length of the fully extended length of foldable supports 16 plus twice the thickness of the left rigid wall 12 and right rigid wall 14, such that the ends 108 of the hanging rod 104 extend past the outer surfaces 34 and 36 of the left rigid wall 12 and right rigid wall 14, respectively, when foldable supports 16 are fully extended.

In another embodiment, shown in FIGS. 2 and 5, the hanging rod 104 further includes mounting points 110 and 112 located close enough to each end 108 of the hanging rod 104, such that the mounting points 110, 112 are located outside of the outer surfaces 34, 36 of the left rigid wall 12 and right rigid wall 14 when foldable supports 16 are fully extended. The mounting points 110, 112 are configured to allow attachment of hangers 114 to the hanging rod 104. The hangers 114 include a large hook 116 at one end, which is sized to conveniently fit over the rods in a conventional, fixed closet. The attachment end 118, which is at the end of hangers 114 opposite large hook 116 of the hangers 114 is configured to attach to mounting points 110, 112. In the exemplary embodiment of FIGS. 2 and 5 mounting points 110, 112 are holes in the hanging rod 104 and an attachment end 118 of the hangers 114 are hooks shaped and sized to fit into those holes. One skilled in the art will appreciate that there are other suitable configurations of the mounting points 110, 112 and attachment end 118, such as welding, press-fit and a threaded end capped with a nut.

The top panel 24 and bottom panel 26 each have a front to back width that is approximately equal to the width of the left and right walls 12, 14. The top panel 24 and bottom panel 26 each have a side to side length that is greater than the length of the fully extended length of foldable supports 16 plus twice the thickness of the thickest part of the left rigid wall 12 and right rigid wall 14, such that the edges 120 of the top panel 24 and bottom panel 26 extend past the outer surfaces 34, 36 of the left rigid wall 12 and right rigid wall 14 when foldable supports 16 are fully extended. The edges 120 of top panel 24 are folded over the top edges 40, 56 of the left and right rigid walls 12, 14 and are attached to the outer surfaces 46, 50 of the left and right rigid walls 12, 14. Preferably, the attachment is made using a series of decorative brads 121. One skilled in the art will recognize that other methods of attachment can be used, including staples, screws, nails or adhesive. The side edge 122 of top panel 24 can extend past the front edges 36, 42 of the left and right rigid walls 12, 14 and can be folded over the front edges 36, 42 of the left and right rigid walls 12, 14 and can be attached to the front edges 36, 42 of the left and right rigid walls 12, 14 in the manner specified above with respect to edges the 120.

The bottom panel 26 is attached to the bottom edges 42, 58 of the left and right sidewalls 12, 14 in a similar fashion as described above for top panel 24. The side edge 124 of top panel 24 can extend past the front edges 36, 42 of the left and right rigid walls 12, 14 and can be folded over the front edges 36, 42 of the left and right rigid walls 12, 14 and can be attached to the front edges 36, 42 of the left and right rigid walls 12, 14 in the manner specified above with respect to edges the 120.

As shown in FIGS. 2-5, a plurality of corner caps 122 are placed over each corner of the top panel 24 and of the bottom panel 26. The corner caps 122 are preferably formed of metal and attached to the left rigid wall 12 and right rigid wall 14 using screws, to provide additional structural integrity. The corner caps 122 can be formed of any material having a strength suitable to reinforce the corners of portable, foldable closet assembly 11, and the attachment can be accomplished using any suitable method, including but not limited to nails or staples.

The rear panel 28, and front panel 30 each have a length that is longer than the length of the fully extended length of foldable supports 16 plus twice the thickness of the left rigid wall 12 and right rigid wall 14, such that the edges 124 of the front and rear panels 28, 30 extend past the outer surfaces 34, 36 of the left rigid wall 12 and right rigid wall 14 when foldable supports 16 are fully extended. The rear panel 28, and front panel 30 are each folded over the front edge 36 and rear edge 54 attached to the outer surfaces 34, 36 of the left rigid wall 12 and right rigid wall 14 in the manner described above with reference to the top panel 24 and bottom panel 26.

In one embodiment, the top panel 24, rear panel 28 and bottom panel 26 can be constructed of individual pieces of fabric. In an alternative embodiment, the top panel 24, rear panel 28 and bottom panel 26 can be formed from a single piece of fabric, which is attached to the left rigid wall 12 and right rigid wall 14 as described above.

Figure 3:
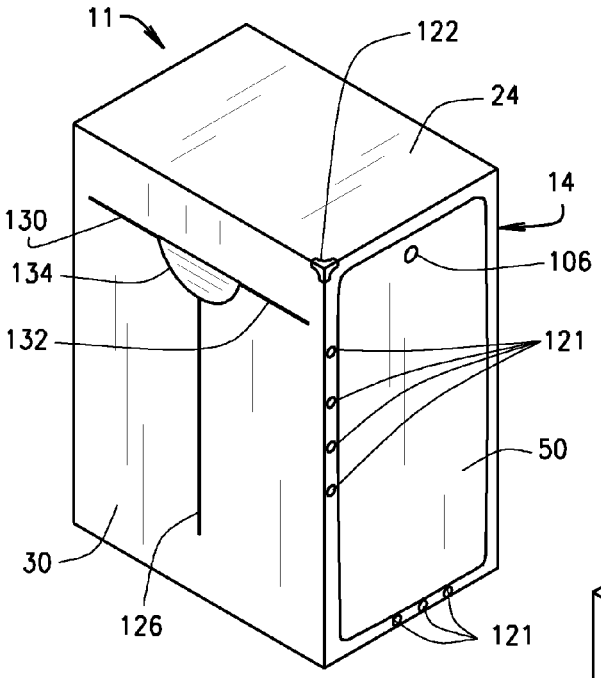
FIG. 3 is a right isometric view of the collapsible, portable, foldable closet assembly in an expanded position according to an embodiment of the present invention.

The front panel 30 includes one or more zippers 126, 130, 132 that act together to allow the front panel 30 to be separated to allow access into the inner volume 128 of the collapsible, portable, foldable closet assembly 11. As shown in FIGS. 3 and 5, in one embodiment, three zippers 126, 130, 132 are provided. One of the zippers 126 is installed in the center of front panel 30 and runs vertically from near the bottom of front panel 30 to the top of front panel 30. A second and a third zipper 130, 132 separate the top pane 24 and top edge of the front panel 30. The three zippers 126, 130 and 132 terminate in proximity to each other with a small opening formed therebetween. This small opening can be covered by a flap 134 that has its upper edge secured as by stitching to the front side of front panel 30.As one skilled in the art will appreciate, other methods of allowing access to the inner volume 128 of the collapsible, portable, foldable closet assembly 11 can be utilized, such as buttons or snaps, or that more or fewer zippers could be provided.

Turning now to the operation of the collapsible, portable, foldable closet assembly 11, and more specifically to the collapsing from an expanded position, with the portable, foldable closet assembly 11 in the expanded position of FIGS. 3-5, 7 and 10, the hangers 114 are removed from the hanging rod 104. The hanging rod 104 is then moved through the holes 106 in the left rigid wall 12 and right rigid wall 14, to remove the hanging rod 104 from the left rigid wall 12 and right rigid wall 14 and out of the inner volume 128. Then, the folding "X" shaped cross-brace 20 is removed from attachment to the rear of the rear panel 28. Next, as shown in FIG. 9, the locking arm 18 of each of the foldable supports 16 is rotated approximately 180° from the position of FIG. 10, to a position where the "U" shaped channel 88 is not engaged with the first arm 60 or the right arm 62. Then, the left rigid wall 12 and right rigid 14 can be moved toward each other. As the left rigid wall 12 and right rigid wall 14 move closer together, the center hinge 74 of each of the foldable supports 16 begins to fold, allowing the first arm 60 and a second arm 62 of each foldable support 16 to move closer together. As this happens, the hinges 76, 78 begin to close which allows the first arm 60 and a second arm 62 of each foldable support 16 to move closer to the inner surfaces 32, 44 of the left rigid wall 12 and right rigid wall 14. When each foldable support has collapsed to the position of FIG. 8, the locking arm 18 of each foldable support can be rotated into a position where one of the "U" shaped channels 88 on each of the foldable supports engages the first arm 60 of each of the foldable supports 16. As the left rigid wall 14 and the right rigid wall 16 continue to move toward each other, the top panel 24, rear panel 28, bottom panel 26 and front panel 30 each collapse into the inner volume 128 of the collapsible, portable, foldable closet assembly 11. In this manner, the collapsible, portable, foldable closet assembly 11 is in a collapsible storage and shipping position in which it is flattened so that the inner volume 128 is minimized. This aspect of the collapsible, portable, foldable closet assembly 11 is advantageous, because it allows easier shipping, merchandising and storage of the collapsible, portable, foldable closet assembly 11. In this collapsed configuration, shown in FIGS. 2, 6, and 7, folding "X" shaped cross-brace 20, hanging rod 104, and hangers 114 can be stored in inner volume 128 of the collapsible, portable, foldable closet assembly 11.

Starting from the collapsed configuration just described, the collapsible, portable, foldable closet assembly 11 is readied for use in an expanded position, by moving the left rigid wall 12 and right rigid wall 14 away from each other, until the top panel 24, rear panel 28, bottom panel 26 and front panel 30 are nearly fully extended. The locking arm 18 of each of the foldable supports 16 is rotated into a position in which the locking arm 18 is substantially parallel to the first arm 60 and to the second arm 62 of each of the foldable supports 16. In this position, the "U" shaped channels 88, 90 face toward the first arm 60 and second arm 62 of each of the foldable supports 16. The rotation of the locking arm 18 of each of the foldable supports 16 continues until the first arm 60 and second arm 62 are engaged inside of the "U" shaped channels 88, 90. In this manner, shown by FIGS. 7 and 10, the foldable supports 16 in the expanded position, become rigid, thus maintaining a predetermined separation between the left rigid wall 12 and right rigid wall 14.

Figure 4:
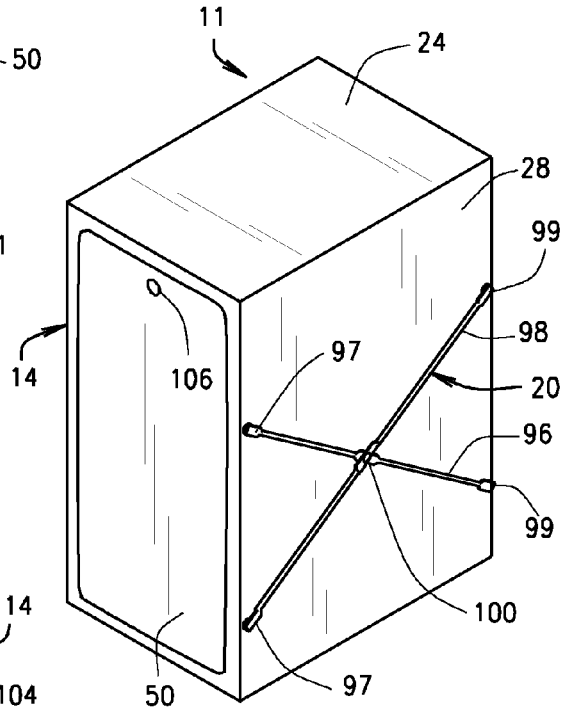
FIG. 4 is a rear isometric view of the collapsible, portable, foldable closet assembly in an expanded position, according to an embodiment of the present invention.

As seen in FIG. 4, the folding "X" shaped cross-brace 20 can be attached to the portable, foldable closet assembly 11 by fastening connectors 100 to mating connectors 120, such that the folding "X" shaped cross-brace 20 is secured to the rear edges 38, 54 of the left rigid wall 12 and right rigid wall 14, respectively, over the outer surface of the rear panel 28. When attached, the folding "X" shaped cross-brace 20 provides support between the left rigid wall 12 and right rigid wall 14, so that the left rigid wall 12 and right rigid wall 14 are not able to be moved with respect to each other.

The hanging rod 104 is installed by sliding the hanging rod 104 through holes 106. The hangers 114 are attached to the hanging rod 104 by inserting the attachment end 118 of the hangers 114 into the mounting points 110, 112. The large hook 116 of each of the hangers 114 can be fit over the rod in a conventional, fixed closet, to provide easier access to the inner volume 128 of the collapsible, portable, foldable closet assembly 11.

Changes can be made in the above constructions without departing from the scope of the disclosure, it is intended that all matter contained in the above description or shown in the accompanying drawings shall be interpreted as illustrative and not in a limiting sense.

What is claimed is:

1. A collapsible closet assembly, comprising:

first and second rigid walls;

a plurality of generally flexible panels extending between the first and second rigid walls;

the assembly having a collapsed configuration for storage wherein the plurality of generally flexible panels are in a folded position, with the first and second rigid walls generally adjacent to each other; the assembly having an expanded position wherein the plurality of generally flexible panels are in a stretched position so that the first and second rigid walls extend generally parallel to each other, and the plurality of panels and the rigid walls form a generally rectangular prism that defines a storage space therein;

a plurality of support struts, each support strut comprising a first support arm and a second support arm, the first arm and second arm each having a configuration of an inner proximal end and an outer distal end, the first and second arms being pivotally connected to each other near their proximal ends and the distal ends of the first and second arms being pivotally connected to the first and second rigid walls, respectively, with the configuration allowing the arms to be capable of pivoting relative to each other generally in a plane that is perpendicular to the rigid walls when the rigid walls are positioned to be generally parallel to each other, the configuration being such to allow the support arms to have an extended expanded position wherein the support arms lie generally in alignment with one another when the assembly is in the expanded position, and the arms capable of pivoting to a collapsed position wherein the first arm is in a position folded toward the second arm at an acute angle; and a plurality of lock arms, each such lock arm being pivotally connected to one of the first or second support arms to pivot relative to the support arm to which it is connected in a plane that is parallel to a plane in which the said connecting support arm lies, the lock arm having a first section located to one side of its pivotal connection to the said connecting support arm and the lock arm having a second section located to the other side of its pivotal connection with the said support arm, the first section of the lock arm having a first locking portion configured for detachable engagement with the first support arm when the support arms are in the expanded position, and the lock arm second section having a second locking portion configured for detachable engagement with the second support arm when the support arms are in the expanded position.

2. The collapsible closet assembly of claim 1, wherein the first locking portion of the lock arm has a shape configured to fit about the first support arm.

3. The collapsible closet assembly of claim 2 wherein the first support arm has opposite sides, and the first locking portion of the lock arm has a shape configured to fit about the opposite sides of the first support arm.

4. The collapsible closet assembly of claim 2 wherein both the first and second locking portions of the lock arms have a generally "U" shape.

5. The collapsible closet assembly of claim 1 wherein the length of the lock arm's first section located to one side of the pivotal connection with the support arm is shorter than the second section of the lock arm located to the opposite side of the pivotal connection to the support arm.

6. The collapsible closet assembly of claim 5 wherein when the first support arm and second support arm are aligned and the lock arm is pivoted to be located in the unlocked position, the shorter first section of the lock arm is located to the outside of the strut and to the inside of the adjacent flexible panel, and the longer second section of the lock arm is located toward the inside of the strut and to the the inside of the inside of the flexible panels.

7. The collapsible closet assembly of claim 1, wherein support arms are capable of pivoting in a plane that is generally perpendicular to the rigid walls when the rigid walls are in the expanded positon.

8. The collapsible closet assembly of claim 1, wherein the first strut support arm and second strut support arm pivot relative to one another in a plane which plane is transverse to the plane through which the lock arm pivots relative to the lock arm to which it is connected.

9. The collapsible closet assembly of claim 1, wherein some of the plurality of support struts are located to the inside of the flexible panels.

10. The collapsible closet assembly of claim 1, further comprising a brace detachably connected to each of the rigid walls when the assembly is in the expanded position configured to hold the walls apart.

11. The collapsible closet assembly of claim 10, wherein the brace comprises first and second brace struts pivotally connected to one another, each brace strut having a first end and second end, and configured to be capable of forming in the expanded position a generally X-shaped cross brace with, when the closet assembly is in the expanded position, the first end of each of the first and second brace struts detachably connected the first rigid wall, and the second end of each of the first and second brace struts detachably connect to the second rigid wall.

12. The collapsible closet assembly of claim 1, further comprising a hanging rod detachably connected between the rigid walls.

13. A collapsible closet assembly, comprising:

first and second rigid walls;

a plurality of generally flexible panels extending between the first and second rigid walls;

the assembly having a collapsed configuration for storage wherein the plurality of generally flexible panels are in a folded position, with the first and second rigid walls generally adjacent to each other; the assembly having an expanded position wherein the plurality of generally flexible panels are in a stretched position so that the first and second rigid walls extend generally parallel to each other, and the plurality of panels and the rigid walls form a generally rectangular prism that defines a storage space therein;

a plurality of support struts, each support strut comprising a first support arm and a second support arm each of which has a generally rectangular cross-section, the first arm and second arm each having a configuration of an inner proximal end and an outer distal end, the first and second arms being pivotally connected to each other near their proximal ends and the distal ends of the first and second arms being pivotally connected to the first and second rigid walls, respectively, with the configuration allowing the arms to be capable of pivoting relative to each other generally in a plane that is perpendicular to the rigid walls when the rigid walls are positioned to be generally parallel to each other, the configuration being such to allow the support arms to have an extended expanded position wherein the support arms lie generally in alignment with one another when the assembly is in the expanded position, and the arms capable of pivoting to a collapsed position wherein the first arm is in a position folded toward the second arm at an acute angle; and a plurality of lock arms, each such lock arm being pivotally connected to one of the first or second support arms to pivot relative to the support arm to which it is connected in a plane that is parallel to a plane in which the said connecting support arm lies but is transverse to the plane in which the first and second strut support arm pivot; the lock arm having a first section located to one side of its pivotal connection to the said connecting support arm and the lock arm having a second section located to the other side of its pivotal connection with the said support arm, the first section of the lock arm having a first locking portion configured to have a generally "U" shape to fit about the rectangular cross-section of the first support arm for detachable engagement with the first support arm when the support arms are in the expanded position, and the lock arm second section having a second locking portion configured to have a generally "U" shape to fit about the rectangular cross-section of the second support arm for detachable engagement with the second support arm when the support arms are in the expanded position;

the length of the lock arm's first section located to one side of the pivotal connection with the support arm being shorter than the second section of the lock arm located to the opposite side of the pivotal connection to the support arm;

the first support arm and second support arm being configured to be capable of being aligned and the lock arm pivoted to be located in the unlocked position, with the shorter first section of the lock arm being located to the outside of the support strut and to the inside of the adjacent flexible panel, and the longer second section of the lock arm is located toward the inside of the support strut and to the the inside of the inside of the flexible panels.

14. The collapsible closet assembly of claim 13, wherein support arms are capable of pivoting in a plane that is generally perpendicular to the rigid walls when the rigid walls are in the expanded positon.

15. The collapsible closet assembly of claim 14, wherein some of the plurality of support struts are located to the inside of the flexible panels.

16. The collapsible closet assembly of claim 13, further comprising a brace detachably connected to each of the rigid walls when the assembly is in the expanded position configured to hold the walls apart.

17. The collapsible closet assembly of claim 16, wherein the brace comprises first and second brace struts pivotally connected to one another, each brace strut having a first end and second end, and configured to be capable of forming in the expanded position a generally X-shaped cross brace with, when the closet assembly is in the expanded position, the first end of each of the first and second brace struts detachably connected the first rigid wall, and the second end of each of the first and second brace struts detachably connect to the second rigid wall.

18. The collapsible closet assembly of claim 13, further comprising a hanging rod detachably connected between the rigid walls.

* * * * *

UNITED STATES PATENT AND TRADEMARK OFFICE

CERTIFICATE OF CORRECTION

PATENT NO. : 9,028,016 B2
APPLICATION NO. : 14/196823
DATED : May 12, 2015
INVENTOR(S) : James L. Glenn It is certified that error appears in the above-identified patent and that said Letters Patent is hereby corrected as shown below:

ON THE TITLE PAGE

Item (12) after Glenn, delete “, Jr.”

Item (72) after James L. Glenn, delete “, Jr.”

Signed and Sealed this
Thirteenth Day of October, 2015

Michelle K. Lee

Michelle K. Lee
*Director of the United States Patent and Trademark Office*